United States Patent [19]

Savage

[11] Patent Number: 5,060,806

[45] Date of Patent: Oct. 29, 1991

[54] VARIABLE-APERTURE SCREEN

[75] Inventor: George M. Savage, Richmond, Calif.

[73] Assignee: Cal Recovery Systems, Incorporated, Richmond, Calif.

[21] Appl. No.: 306,106

[22] Filed: Feb. 6, 1989

[51] Int. Cl.[5] ..... B07B 13/04

[52] U.S. Cl. ..... 209/668; 74/397; 74/521; 209/672

[58] Field of Search ..... 209/667, 668, 671, 672, 209/674; 74/392, 395-397, 413, 521, 840

[56] References Cited

U.S. PATENT DOCUMENTS

| | | | |
|---|---|---|---|
| 1,173,737 | 2/1916 | Quesnell | 209/668 |
| 1,200,241 | 10/1916 | Ritchie | 209/672 |
| 2,640,371 | 6/1953 | Rosenleaf | 74/397 |
| 2,843,330 | 7/1958 | Gundlach | 74/392 X |
| 3,265,206 | 8/1966 | Allen | 209/672 |
| 3,396,843 | 8/1968 | Allen | 209/668 |
| 3,848,741 | 11/1974 | Haley et al. | 209/668 |
| 4,037,723 | 7/1977 | Wahl et al. | 209/672 |
| 4,266,676 | 5/1981 | Ruckstuhl et al. | 209/672 |
| 4,301,930 | 11/1981 | Smith | 209/671 |
| 4,452,694 | 6/1984 | Christensen et al. | 209/667 X |
| 4,627,541 | 12/1986 | Johnson | 209/668 |
| 4,658,964 | 4/1987 | Williams | 209/672 X |
| 4,901,864 | 2/1990 | Daugherty | 209/672 |

FOREIGN PATENT DOCUMENTS

| | | | |
|---|---|---|---|
| 0577974 | 6/1959 | Canada | 209/673 |

*Primary Examiner*—Michael S. Huppert
*Assistant Examiner*—Edward M. Wacyra
*Attorney, Agent, or Firm*—Thomas R. Lampe

[57] ABSTRACT

Apparatus for separating material into first and second portions according to size including a plurality of shafts, a plurality of spaced disks radiating outwardly from each of the shafts to define apertures and linkage interconnecting the shafts for moving the shafts toward or away from one another to vary the size of the apertures while the apparatus is performing the separating function.

14 Claims, 7 Drawing Sheets

VARIABLE-APERTURE SCREEN

TECHNICAL FIELD

The U.S. Government has a paid-up license in this invention and the right in limited circumstances to require the patent owner to license others on reasonable terms as provided for by the terms of contract No. DE-AC03-87ER80414 awarded by the U.S. Department of Energy.

This invention relates to apparatus for separating one portion of a material from a second portion thereof according to size. More particularly, the device relates to a screen which employs a plurality of rotatable shafts having spaced disks radiating outwardly therefrom to perform the desired separating function. The device of the present invention incorporates structure which allows for the ready adjustment of the shafts toward and away from one another so that the size of the apertures defined by the spaced disks connected to the shafts and by the shafts can be varied.

BACKGROUND ART

Screens with rotating shafts are well known in the prior art. One example of a separator of this type is that disclosed in U.S. Pat. No. 4,037,723, issued July 26, 1977. The apparatus of this patent incorporates interleaved rotating disks rotating in the same direction whereby material fed onto the tops of the disks will be passed along from one row to the next, the finer material dropping through the spaces between adjacent disks. The coarser material is carried along on top of the disks whereby separation of fine and coarse material may be obtained. The separator of U.S. Pat. No. 4,037,723 provides means for accurately spacing the disks of one row relative to the those of an adjacent row and for changing the spacing of the disks. This can only be accomplished during separator downtime. The distance between the shafts employed in the separator is fixed.

U.S. Pat. No. 4,301,930, issued Nov. 24, 1981 also shows a screen apparatus of the type having a series of rotating shafts, each of which has a longitudinal series of concentric screen disks which mesh with the screen disks of adjacent shafts. The screen disks are carried by tubular modules mounted in end-to-end relation on the shaft. The shafts utilized in the machine remain a fixed distance from one another.

U.S. Pat. No. 4,658,964, issued Apr. 21, 1987, relates to a screen composed of a bed of rotary disks in spaced relation and formed in the periphery with undulating surfaces for constantly agitating the waste material to be screened. The apparatus includes a controllable drive system for the rotary disks which adjusts the speed of the disks. The shafts upon which the disks are mounted remain in fixed position relative to one another.

U.S. Pat. No. 4,266,676, issued May 12, 1981, also relates to apparatus for separating material. The separator disclosed in this patent incorporates a series of non-circular disks, such as elliptical or three lobed disks. These disks are mounted on each shaft and interspaced with the disks on adjacent shafts. There is no disclosure in U.S. Pat. No. 4,266,676 of varying the distances between the shafts themselves.

DISCLOSURE OF INVENTION

The present invention, in common with the devices disclosed in the aforementioned patents, incorporates a plurality of rotating shafts mounted on a support. Also as is conventional, a plurality of spaced disks radiates from each of the shafts with the disks of each of the shafts staggered relative to the disks on shafts adjacent thereto. The disks, therefore, define a plurality of apertures between adjacent shafts. In contrast to prior art arrangements, however, the present invention incorporates means for selectively moving the shafts on their supports toward or away from one another to vary the size of the apertures. The shafts may be moved even while the apparatus is in operation.

Another important feature of the apparatus of this invention resides in the fact that the shafts have spaced circumferential notches formed therein, such notches being in general alignment with the disks radiating outward from adjacent shafts. When the shafts are moved toward one another, such notches will receive at least a portion of disks of adjacent shafts. In this manner, the size of the apertures between the shafts may be reduced to a greater degree than would otherwise be possible.

The means for selectively moving the shafts includes accordion linkage comprised of a plurality of pivotally interconnected arms. The shafts are rotatably mounted on the linkage as is transmission means including a plurality of interconnected gears mounted for rotational movement on the linkage. Some of these gears are fixably attached to the shafts whereby rotation of the gears will rotate the shafts. Because of the unique character of the apparatus constructed in accordance with the teachings of the present invention, the gears will remain in engagement even as the length of the accordion linkage is varied.

In the specific embodiment of the invention disclosed herein the structural sub-combination set forth in the immediately preceding paragraph is employed in apparatus for separating one portion of a material from a second portion thereof. However, it is to be understood that such structural sub-combination may have application in other operational contexts and with other types of equipment without departing from the spirit or scope of the present invention.

Other features, advantages and objects of the present invention will become apparent with reference to the following detailed description and accompanying drawings.

BEST MODE FOR CARRYING OUT THE INVENTION

Figure 1:
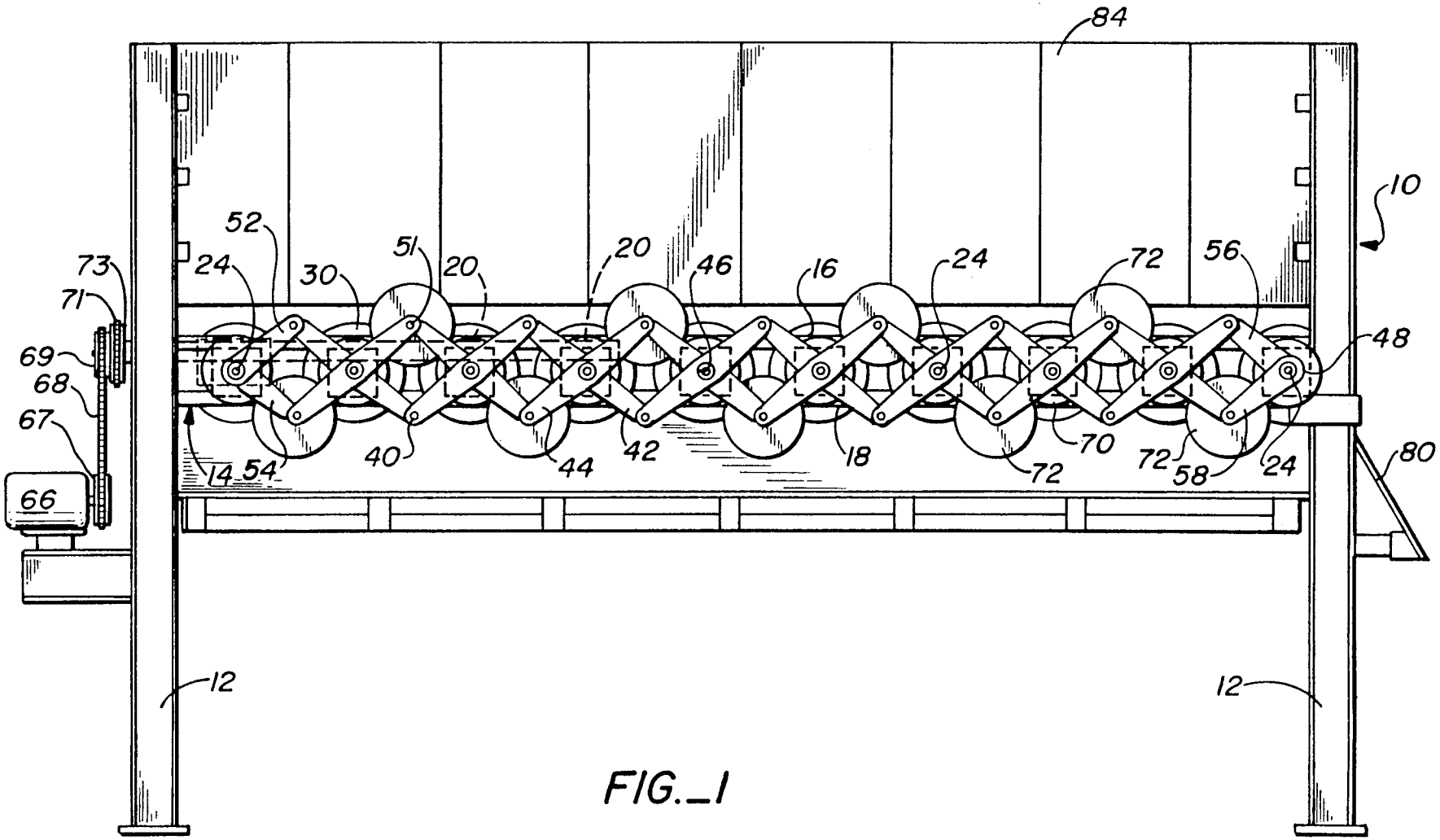
FIG. 1 is a side elevation of a preferred form of variable aperture screen constructed in accordance with the teachings of the present invention and illustrating an accordion linkage thereof fully extended.
Figure 3:
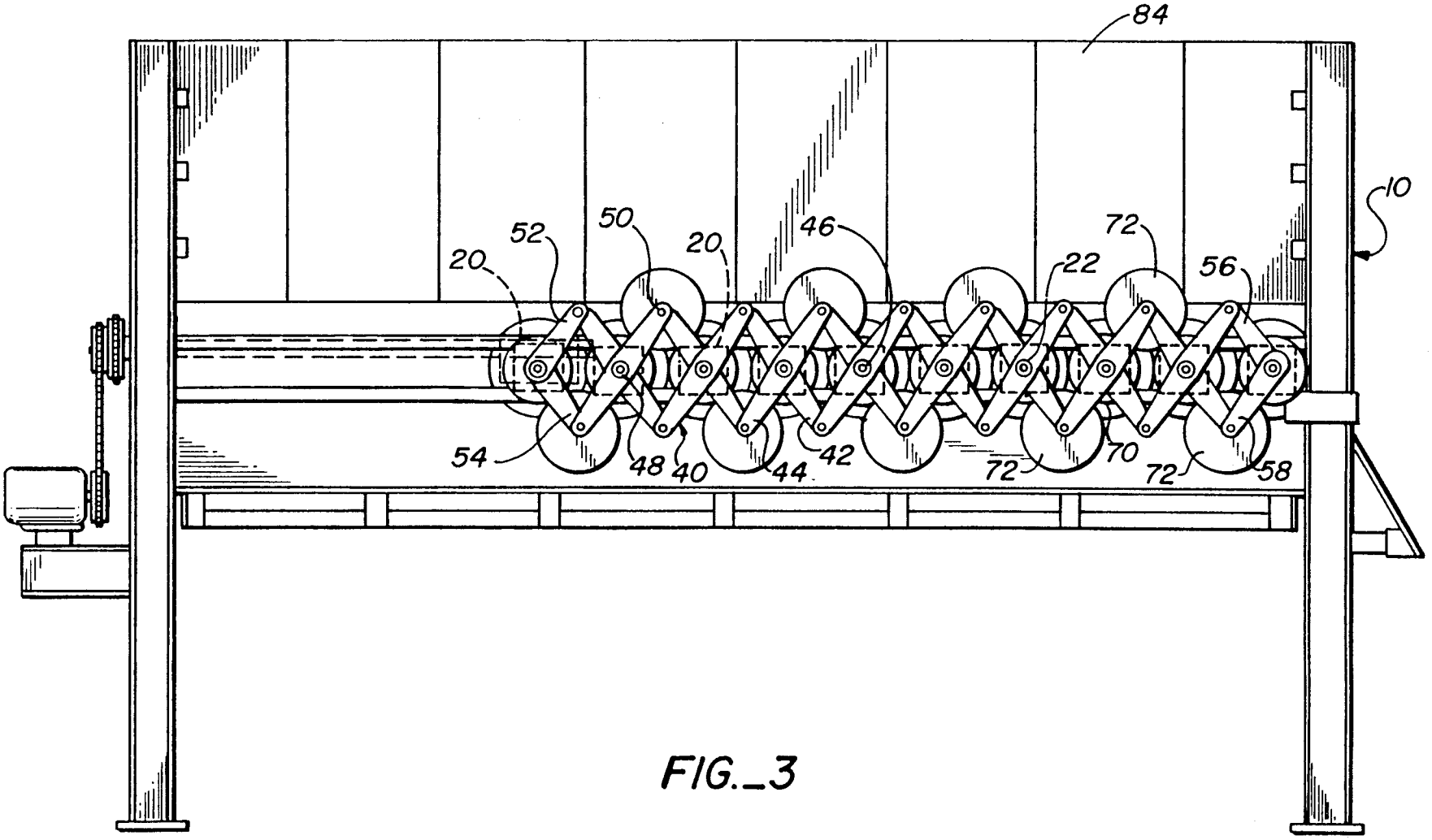
FIG. 3 is a view similar to that of FIG. 1 but illustrating the accordion linkage of the variable aperture screen in a shortened condition, i.e. the condition of the apparatus when the shafts thereof have been brought into close proximity.
Figure 5:
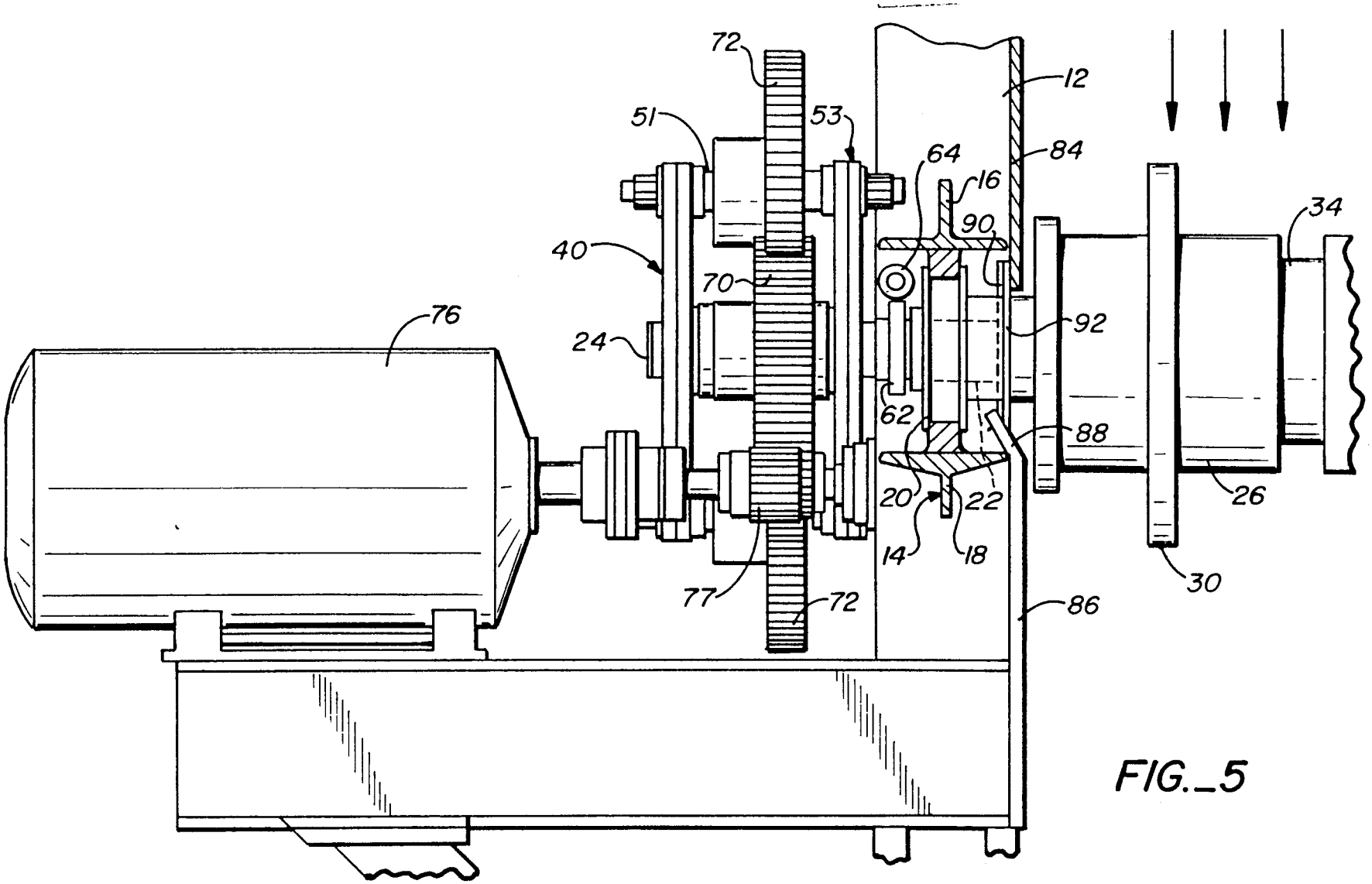
FIG. 5 is an enlarged, fragmentary view in partial cross-section showing selected details of the apparatus.

Referring now to the drawings, a preferred form of apparatus constructed in accordance with the teachings of the present invention is illustrated. The apparatus includes a support in the form of a framework 10 including corner posts 12 disposed at four corners thereof. A track or guideway 14 extends along each of the longitudinal sides of framework 1 with the ends thereof attached in any suitable manner to a pair of corner posts 12. One such track 14 is shown in FIGS. 1, 3 and 5 but it will be appreciated that a similar track is disposed along the other side of the framework 10.

Track 14 includes a top rail 16 and a bottom rail 18 spaced therefrom. This may perhaps best be seen with reference to FIG. 5. Disposed between the top rail 16 and the bottom rail 18 of each track 14 are a plurality of bearing members 20 in slidable engagement therewith. The bearing members 20 are free, in the absence of any outside restraining force, to move longitudinally along track 14. Each of the bearing members 20 defines an aperture 22 within which is disposed the reduced end 24 of a shaft 26. As may perhaps best be seen with reference to FIGS. 2, 4, and 7, a plurality of such shafts 26 are mounted on the framework in a spaced, substantially parallel relationship. The primary axis of each shaft is disposed perpendicularly to the primary axis of the framework 10, as shown.

A plurality of spaced disks 30 radiate outwardly from each of the shafts 26. The disks 30 of each shaft are, as shown, staggered relative to the disks on shafts adjacent thereto. Thus, the disks 30 define a plurality of apertures 32 between adjacent shafts. It should also be noted that the shafts 26 have spaced circumferential notches 34 formed therein, with the notches of each of the shafts being in general alignment with the disks 30 radiating outwardly from adjacent shafts.

An important feature of the present invention resides in the fact that the distance between the shafts, and thus the size of the apertures 32, may readily be varied during operation. The apparatus of the present invention is, of course, utilized to separate material into first and second portions according to size. In common with conventional separators with rotating shafts the material is delivered to the top of the shafts. The first portion of the material comprising the smaller discrete components will fall through the apertures defined by the disks. The larger components of the material, or second portion thereof, will be retained on top of the device. It will be appreciated that by reducing or enlarging the size of the apertures 32 there will be a different apportionment between the material first and second portions. With the arrangement disclosed herein this change can be readily and quickly effected, even while the screen is operating. The cooperative structure providing this adjustability feature will now be described.

Figure 2:
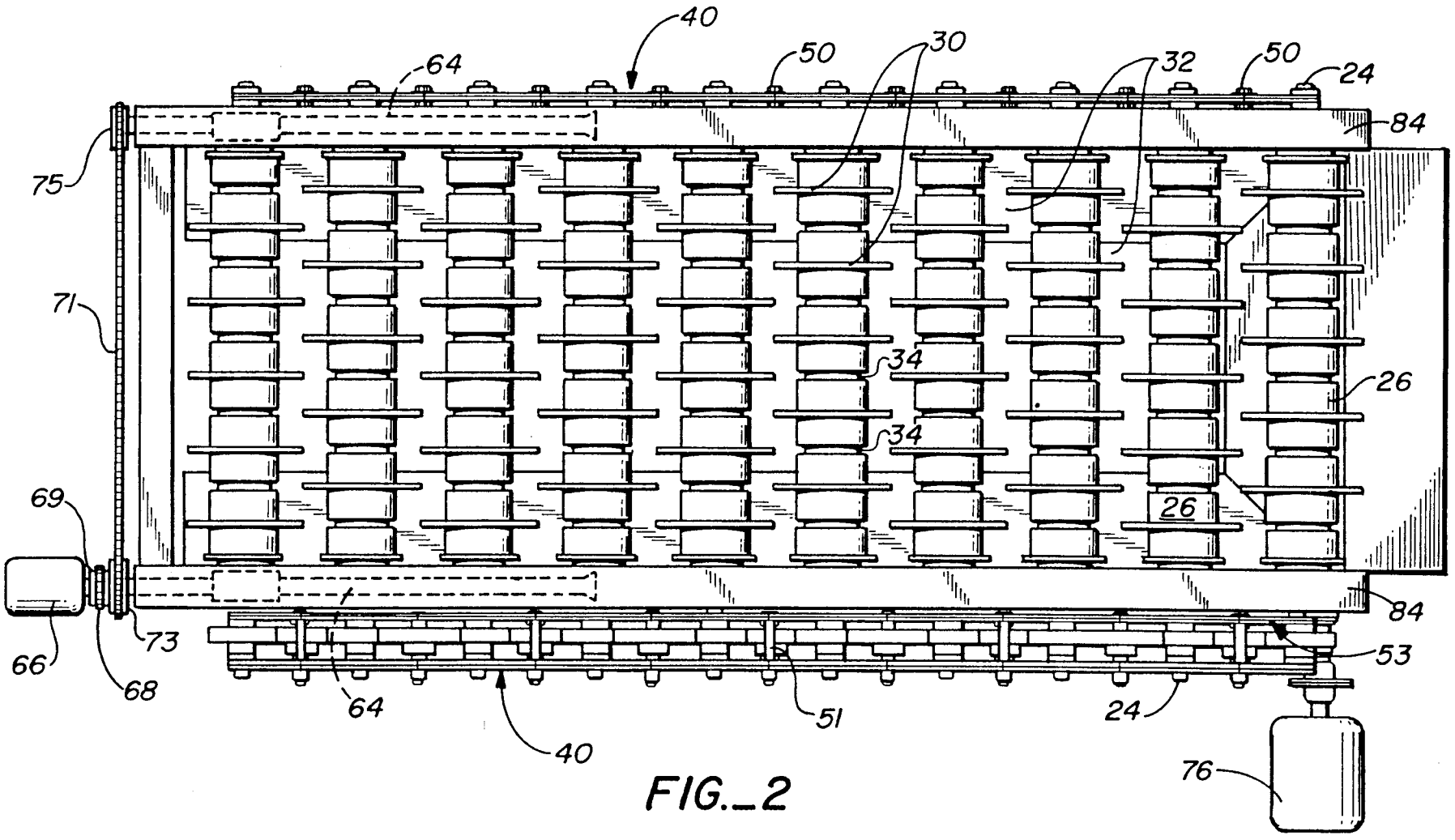
FIG. 2 is a plan view of the variable aperture screen in the operative condition illustrated in FIG. 1.

Both reduced shaft ends 24 of each shaft 26 project beyond their associated bearing members 20. Each shaft end 24 has pivotally disposed thereon two linkage arms of an accordion linkage 40. In other words, there are a pair of accordion linkages 40, one such linkage on each side of the apparatus. The linkage arms operatively associated with each shaft end 24 (with the exception of the two outer-most shafts which are discussed below) are an inner linkage arm 42 and an outer linkage arm 44. Linkage arms 42, 44 each have an enlarged central portion defining a throughbore 46. Disposed about the throughbore 46 is a bearing 48. The outer ends of linkage arms 42, 44 are connected by pins which allow relative rotational movement between the linkage arms. With reference to FIG. 2, the pins connecting linkage 40 at the top of such figure are designated by reference numeral 50. Linkage 40 at the bottom of the figure is interconnected by pins 51. Pins 51 are longer than pins 50 and extend from their associated linkage arms to the linkage arms of a third accordion linkage 53 positioned side-by-side which is essentially identical in construction to accordion linkages 40.

The left ends (as viewed in FIG. 1) of the accordion linkages comprise shorter end linkage arms 52, 54. At one end thereof the end linkage arms are pivotally attached to the ends of the inner and outer linkage arms 42, 44. At the other end thereof, the end linkage arms 52, 54 are pivotally connected to the shaft end 24 of the left-most shaft 26. A similar arrangement exists at the right ends (as viewed in FIG. 1) of the accordion linkages whereat end linkage arms 56, 58 are journalled about the shaft end 24 of the shaft disposed at the extreme right.

Disposed about each shaft end 24 of the left-most shaft 26 (as viewed in FIG. 1) is a block element 62 (FIGS. 5, 7 and 8) having a threaded aperture therein which receives an elongated screw element 64. There are a pair of such elongated screw elements 64 as may perhaps best be seen with reference to FIGS. 2 and 4. Rotation of the elongated screw elements 64 will cause movement of the block elements 62. The means for effecting such movement is a prime mover such as electric motor 66 having a gear 67 on the output shaft thereof. Such gear is interconnected with a drive chain 68 which extends to another gear 69 fixedly connected to the end of one screw element 64. A second chain or belt 71 extends from a gear 73 attached to the same screw element end to a gear 75 attached to the end of the other screw element 64. Simultaneous rotation of the screw elements by this arrangement will effect corresponding movement of both block elements 62.

Figure 4:
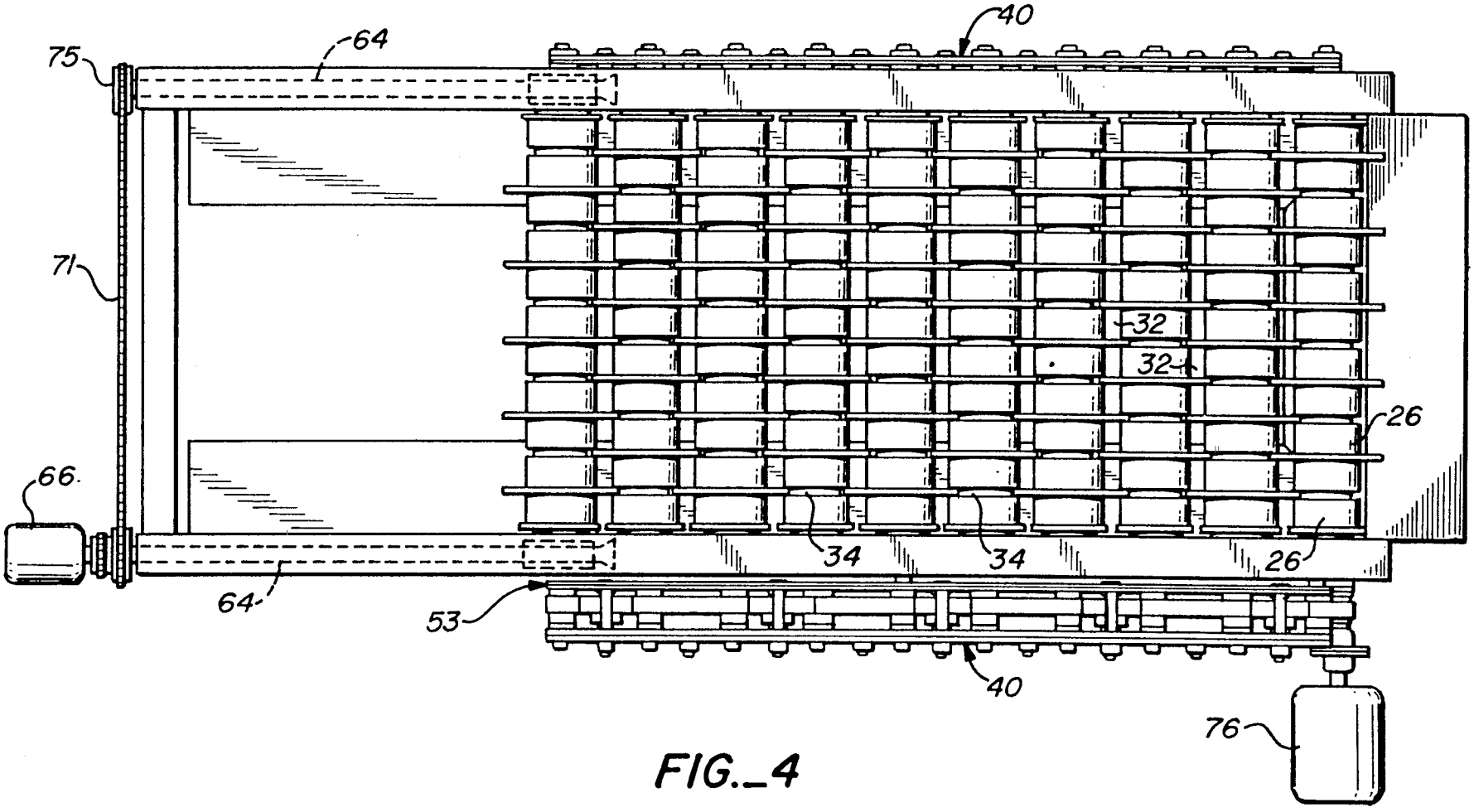
FIG. 4 is a view similar to that of FIG. 2 but illustrating the apparatus in the operative condition of FIG. 3.
Figure 7:
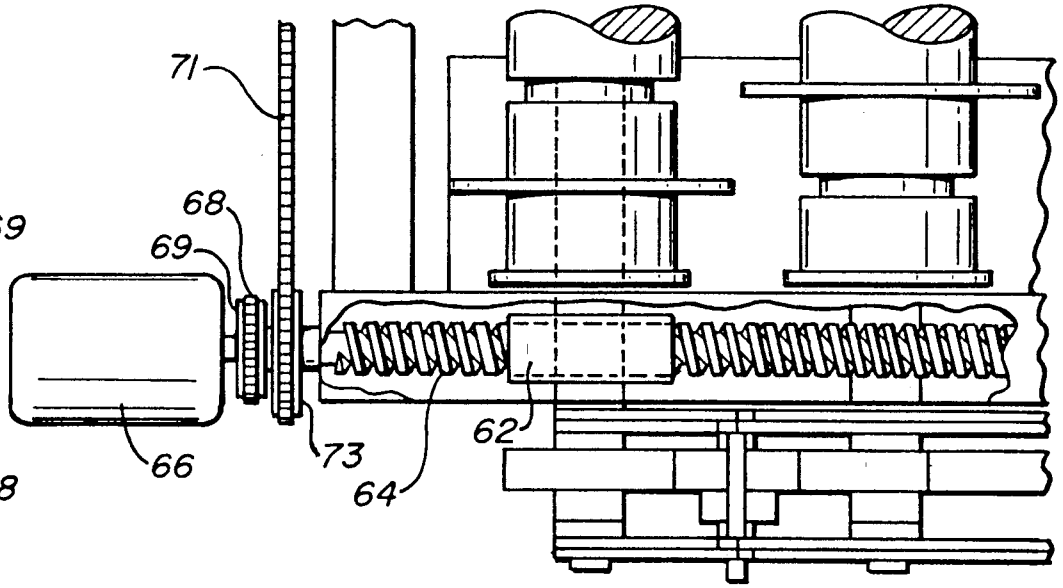
FIG. 7 is an enlarged, fragmentary plan view showing operational details of the mechanism for moving the shafts and with the shafts at the point of maximum separation.
Figure 8:
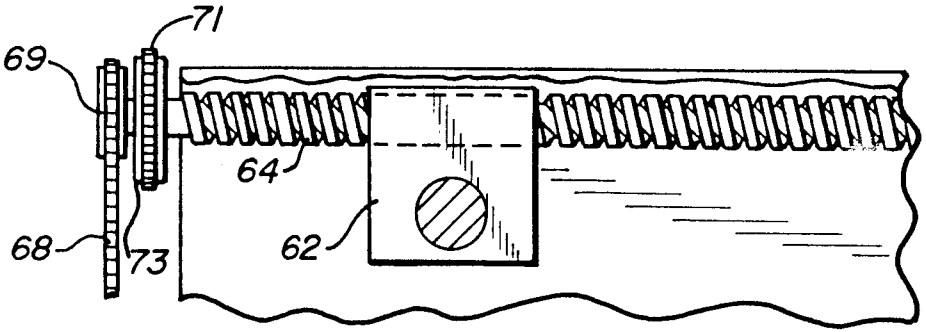
FIG. 8 is an enlarged, fragmentary side view showing selected operational details of the mechanism of FIG. 7.
Figure 6:
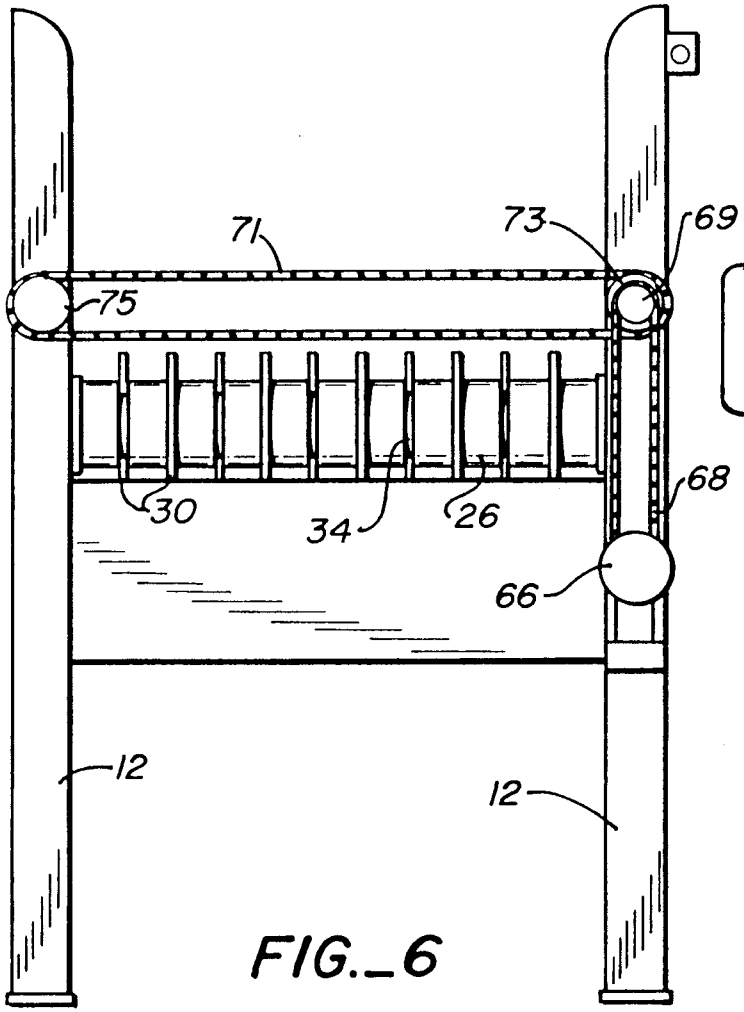
FIG. 6 is an end view of the apparatus illustrating certain elements thereof diagrammatically.

It will be appreciated that movement of block element 62 in one direction will cause the accordion linkages 40, 53 to collapse while rotation thereof in the opposite direction will cause the accordion linkages to expand. FIGS. 1, 2, and 7 show the accordion linkages in their fully extended position, that is, the condition in which the shafts 26 are furthest apart and the apertures 32 are largest. FIGS. 3 and 4, on the other hand, show the accordion linkages collapsed to the maximum degree. When this latter condition exists, the shafts are at their closest and the apertures 32 at their smallest. It will be appreciated that the shafts and apertures may be adjusted in size at any intermediate condition between the two extremes just discussed.

Referring now to FIG. 4, it will be seen that when the shafts are closest, the disks radiating outwardly from any one of the shafts will have an outer portion thereof received in the circumferential notches 34 of adjacent shafts. This feature enables the apertures 32 to be adjusted smaller than would otherwise be the case. This feature provides additional flexibility to the arrangement disclosed.

Importantly, the shafts and disks may be continuously rotated even while the spacing between the shafts is adjusted. One shaft end 24 of each shaft 26 has a shaft gear 70 affixed thereto. Shaft gears 70 are part of a transmission means further including intermediate gears 72 journalled on pins 51. Gears 70 and 72 are always maintained in engagement regardless of whether the accordion linkage 40 with which they are associated is extended or contracted. The entire gear transmission is driven by a prime mover such as electric motor 76, having a drive gear 77 which drives the shaft gear 70 affixed to the shaft 26 disposed at the extreme right as viewed in FIG. 1. Such shaft gear 70 rotates clockwise as viewed in FIG. 1. The intermediate gear 72 meshing therewith, on the other hand, rotates counterclockwise as, for that matter, do all of the intermediate gears 72 incorporated in the transmission. All of the shaft gears 70 rotate clockwise.

Thus, material engaging the tops of the shafts and disks will tend to be urged toward the right as viewed in FIG. 1 so that the portion of the material remaining thereon is gradually transported to the right until it leaves the shafts and disks and drops onto a deflection plate 80. That portion of the material small enough to drop through apertures 32, on the other hand, will drop directly to any desired receiving surface which may, for example, be a conveyor (not shown). Upper side plates 84 are connected to framework 10 and run along opposed sides of the apparatus above the shafts 26. This may perhaps best be seen with reference to FIG. 5. A lower side plate 86 is also provided, said opposed lower side plates being canted at the top thereof as at 88.

Figure 9:
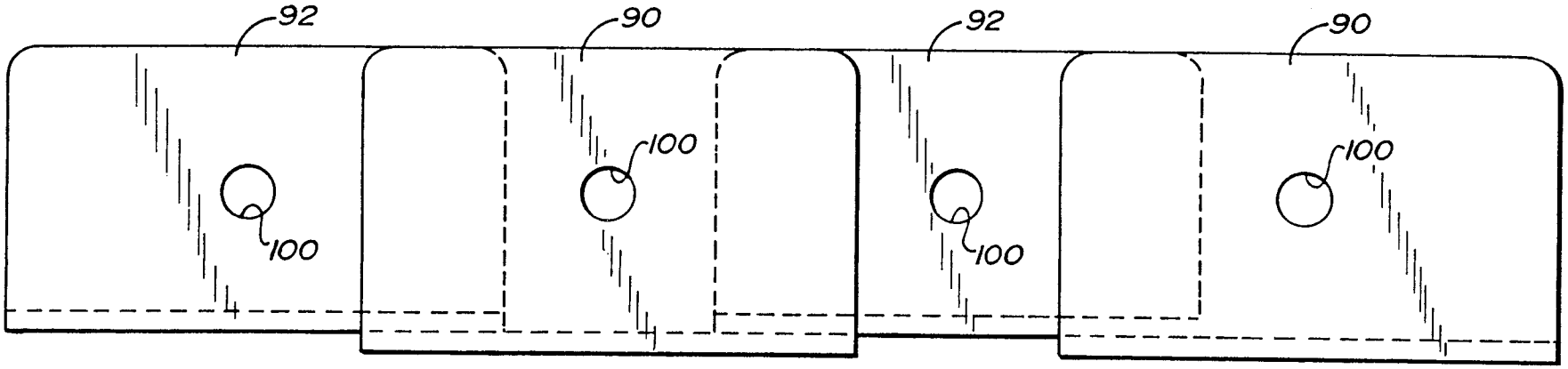
FIG. 9 and 10 are diagrammatic side and plan views, respectively, of a portion of a sidewall of the apparatus.
Figure 10:
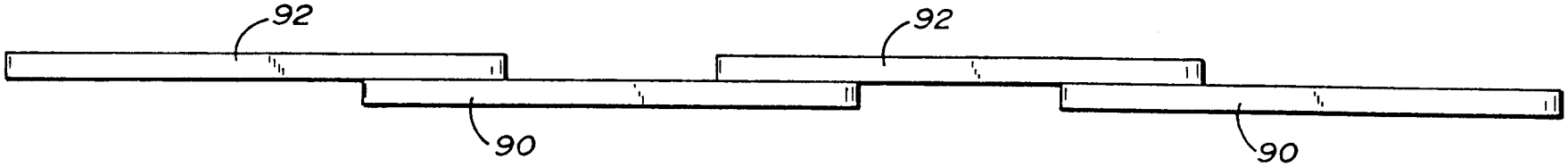

Disposed between the upper and lower side plates are side wall elements 90, 92. The side wall elements 90, 92 have apertures 100 (see FIGS. 9 and 10) which accommodate the ends of shafts 26. When the accordion linkages are contracted or expanded the side wall elements will move with their associated shafts. Because the side wall elements are staggered from side-to-side adjacent side wall elements can slide in face-to-face engagement and cooperate to keep material from falling off the shaft ends between the upper and lower side plates.

It will be appreciated that as the accordion linkages 40, 53 are contracted, delivery of the material to the device must come from a location above the shaft-disk bed. In other words, if such material were dropped onto the device at the extreme left as viewed in FIG. 1 when the accordion linkages are contracted it would fall through the framework without engaging the rotating shafts and disks. To insure that this does not happen, the material may be delivered to the device by an overhead conveyor (not shown) which automatically extends when the accordion linkage contracts so that there will be no misdirection of the material to be separated.

What is claimed is:

1. Apparatus adapted to separate material into first and second portions according to size, said apparatus comprising, in combination:

a support;

a plurality of cylindrically-shaped shafts movably mounted on said support in spaced, substantially parallel relationship and adapted to receive said material, each of said plurality of shaft having a longitudinal axis and defining spaced circumferential notches, said notches radiating outwardly at right angles to said longitudinal axis, with the notches defined by each of said shafts being offset from and out of alignment with the notches defined by shafts adjacent thereto and the notches defined by alternate shafts being in alignment with one another;

a plurality of spaced, generally flat disks radiating outwardly from each of said shafts at right angles to the longitudinal axis thereof, with the disks of each of said shafts staggered relative to the disks on shafts adjacent thereto and defining therewith a plurality of apertures between adjacent shafts, said apertures permitting passage of said first portion therethrough under the influence of gravity to separate said first portion from said second portion, said disks of each of said shafts being located between the notches defined thereby and in alignment with the notches defined by adjacent shafts, whereby disks of alternate shafts are in alignment;

means for rotating said shafts; and means for selectively moving said shafts on said support toward or away from one another to vary the size of said apertures including linkage interconnecting said shafts and adapted to cause substantially simultaneous movement of said shafts relative to said support while maintaining substantially parallel relationship between said shafts, said notches of each of said shafts receiving therein at least a portion of the disks radiating outwardly from adjacent shafts when said shafts are moved toward one another by said means for selectively moving said shafts, said apertures being discrete and having a rectangular configuration defined by the outer peripheries of said shafts between the notches defined thereby and said disks when said disk portions are received by said notches.

2. The apparatus according to claim 1 wherein said linkage is an accordion linkage comprised of a plurality of pivotally interconnected arms, said shafts each being connected at at least one end thereof to said accordion linkage.

3. The apparatus according to claim 1 wherein said means for rotating said shafts includes prime mover means and transmission means operatively associated with said prime mover means and said shafts to simultaneously rotate said shafts upon actuation of said prime mover means.

4. The apparatus according to claim 3 wherein said means for selectively moving said shafts includes linkage interconnecting said shafts and adapted to cause substantially simultaneous movement of at least some of said shafts relative to said support, said transmission means including a plurality of interconnected gears mounted for rotational movement on said linkage, at least some of said gears attached to said shafts.

5. The apparatus according to claim 4 wherein said linkage includes a pair of spaced accordion linkages, one of said accordion linkages disposed at one end of said shafts and the other of said accordion linkages disposed at the other end of said shafts, said shafts being journalled in said spaced accordion linkages and extending therebetween.

6. The apparatus according to claim 5 additionally comprising means interconnecting said accordion linkages and adapted to simultaneously change the length of said accordion linkages.

7. In combination:

a framework;

at least one accordion linkage mounted for movement relative to said framework, said accordion linkage comprising a plurality of linkage arms pivotally interconnected at ends thereof and at locations substantially mid-point between said ends;

bearing members located at said mid-point locations;

a plurality of rotatable shafts, each said shaft having an end rotatably disposed in one of said bearing members;

a plurality of first gears, said first gears rotatably mounted on said accordion linkage at the pivotally interconnected ends thereof;

a plurality of second gears, said second gears attached to said shafts and in operable engagement with said first gears; and means for simultaneously rotating said first and second gears and said shafts.

8. The combination according to claim 7 wherein said framework includes a track, said bearing members being mounted for linear movement in said track.

9. The combination according to claim 8 including means for causing relative movement of said bearing members in said track to vary the length of said accordion linkage and the distance between said shafts.

10. The combination of claim 9 wherein at least some of said shafts have a plurality of spaced disks radiating outwardly therefrom, with the disks projecting from said shafts staggered relative to the disks on adjacent shafts whereby a plurality of apertures are defined between adjacent shafts by the disks radiating outwardly therefrom, the size of said apertures being varied as the length of said accordion linkage is varied.

11. The combination of claim 10 wherein said shafts have spaced circumferential notches formed therein, said notches of each of said shafts being in general alignment with the disks radiating outwardly from adjacent shafts and adapted to receive therein, at least a portion of said disks when the length of said accordion linkage is shortened.

12. The combination of claim 7 additionally including side wall elements disposed at the ends of said shafts, adjacent side wall elements being disposed in face-to-face relation and adapted for relative movement.

13. The combination of claim 12 additionally including side plates disposed above and below said side wall elements.

14. In apparatus for separating material into first and second portions according to size, the following combination:

a framework;

at least one accordion linkage mounted for movement relative to said framework, said accordion linkage comprising a plurality of linkage arms pivotally interconnected at ends thereof and locations substantially mid-point between said ends;

bearing members located at said mid-point locations;

a plurality of rotatable shafts, each said shaft having an end rotatably disposed in one of said bearing members;

a plurality of spaced disks radiating outwardly of said shafts, with the disks projecting from said shafts staggered relative to the disks on adjacent shafts to define with said shafts a plurality of apertures, said shafts and disks engageable by said material;

a plurality of first gears, said first gears rotatably mounted on said accordion linkage at the pivotally interconnected ends thereof;

a plurality of second gears, said second gears attached to said shafts and in operable engagement with said first gears; and means for simultaneously rotating said first and second gears and said shafts.

* * * * *